US005107547A

United States Patent [19]

Scheu

[11] Patent Number: 5,107,547

[45] Date of Patent: Apr. 28, 1992

[54] ADJUSTABLE MEDICAL FACE MASK FASTENER

[75] Inventor: Peter W. Scheu, Chicago, Ill.

[73] Assignee: Baxter International Inc., Deerfield, Ill.

[21] Appl. No.: 639,471

[22] Filed: Jan. 10, 1991

[51] Int. Cl.[5] ..... A41D 13/00; A62B 18/02

[52] U.S. Cl. ..... 2/206; 2/9; 2/DIG. 7; 128/206.19; 128/207.11; 289/1.2

[58] Field of Search ..... 2/206, DIG. 7, 52, 189, 2/9; 128/206.12, 206.19, 206.21, 206.28, 206.27, 207.11; 289/1.2, 1.5; 132/57.1, 58, 319

[56] References Cited

U.S. PATENT DOCUMENTS

| | | | |
|---|---|---|---|
| 2,039,681 | 5/1936 | Chatfield | 128/206.19 |
| 2,056,753 | 10/1936 | Wagner | 128/206.19 |
| 2,281,744 | 5/1942 | Brunner | 128/206.19 |
| 2,751,905 | 6/1956 | Creelman | 128/206.19 |
| 2,888,682 | 6/1959 | Du Bois et al. | 289/1.2 |
| 3,802,429 | 4/1974 | Bird | 128/206.19 |
| 3,884,227 | 5/1975 | Lutz et al. | 128/146.2 |
| 3,888,246 | 6/1975 | Lauer | 128/146.2 |
| 3,890,966 | 6/1975 | Aspelin et al. | 128/146.2 |
| 3,955,570 | 5/1976 | Hutter, III | 128/142.7 |
| 3,971,369 | 7/1976 | Aspelin et al. | 128/146.2 |
| 3,974,829 | 8/1976 | Tate, Jr. | 128/146.2 |
| 4,037,593 | 7/1977 | Tate, Jr. | 128/146.2 |
| 4,084,949 | 4/1978 | Biggins | 55/524 |
| 4,269,315 | 5/1981 | Boyce | 206/438 |
| 4,296,746 | 10/1981 | Mason, Jr. et al. | 128/201.15 |
| 4,312,338 | 1/1982 | Glassman | 128/206.12 |
| 4,355,637 | 10/1982 | Dyer | 128/206.19 |
| 4,419,993 | 12/1983 | Peterson | 128/206.19 |
| 4,589,408 | 5/1986 | Singer | 128/132 R |
| 4,606,341 | 8/1986 | Hubbard et al. | 128/206.19 |
| 4,635,625 | 1/1987 | Teeple | 128/163 |
| 4,635,628 | 1/1987 | Hubbard et al. | 128/206.19 |
| 4,662,005 | 5/1987 | Grier-Idris | 2/9 |
| 4,673,084 | 6/1987 | Hubbard et al. | 206/438 |
| 4,711,476 | 12/1987 | Hanson | 289/1.5 |
| 4,722,100 | 2/1988 | Greer | 2/205 |
| 4,790,307 | 12/1988 | Haber et al. | 128/206.19 |
| 4,796,621 | 1/1989 | Barle et al. | 128/206.23 |
| 4,802,473 | 2/1989 | Hubbard et al. | 128/206.19 |
| 4,850,051 | 7/1989 | Hodge | 2/52 |
| 4,920,960 | 5/1990 | Hubbard et al. | 128/206.12 |
| 4,966,140 | 10/1990 | Herzberg | 2/206 |

FOREIGN PATENT DOCUMENTS

| | | | |
|---|---|---|---|
| 233323 | 4/1961 | Australia | 128/206.19 |
| 1052690 | 9/1953 | France | 128/206.19 |
| 479807 | 2/1938 | United Kingdom | 128/146 |
| 780710 | 8/1957 | United Kingdom | 128/206.19 |

OTHER PUBLICATIONS

Tecnol, Inc., "Fluidshield Surgical Mask", Cat. No. 47123-080.

*Primary Examiner*—Werner H. Schroeder
*Assistant Examiner*—Amy Vanatta
*Attorney, Agent, or Firm*—Paul E. Schaafsma; Amy L. H. Rockwell; Paul C. Flattery

[57] ABSTRACT

The problem of providing a medical face mask 10 that may be quickly, easily, securely and adjustably mounted to the head of a wearer 72 is solved in a medical face mask 10 of the type having a panel 12 for covering the nose and the mouth of a wearer 72 and at least one complimentary pair of spaced apart straps 30 and 32 attached to the panel 12 and extending therefrom by the straps 30 and 32 being joined by a slidable fastener 54 forming a loop 62 comprising the straps 30 and 32 and the top 16 of the panel 12, the slidable fastener 54 holding the straps 30 and 32 in a loop 62 of desired length until the slidable fastener 54 is forcibly slidably adjusted to increase or decrease the size of the loop 62.

12 Claims, 1 Drawing Sheet

ADJUSTABLE MEDICAL FACE MASK FASTENER

BACKGROUND OF THE INVENTION

1. Technical Field

The present invention is directed toward medical face masks, and more particularly toward a slidable fastener for medical face mask straps.

2. Background

Medical science has long recognized the need to provide a germ-free environment in operating rooms. In addition, the recent Acquired Immune Deficiency Syndrome (AIDS) epidemic and related influx of HIV positive patients into health service facilities, combined with the long standing concern over hepatitis, has driven home the need of medical professionals outside the operating room to protect themselves from contracting these and other contagious diseases from infected patients. To meet these needs, doctors and nurses are required to wear medical face masks both to prevent exhaled germs from contaminating the operating room environment and to prevent contracting communicable and dangerous diseases from the patients they treat.

Medical masks typically include a panel for covering the nose and mouth constructed of material allowing the free passage of air but preventing the permeation of germs therethrough and tie strings or straps extending from the panel for attaching the mask about the wearer's head. Prior to beginning an operation or tending to an infectious patient the straps of these masks must be placed about the wearer's head and tied into a knot to secure the mask. Unfortunately, this conventional fastening means presents several serious problems.

When mounting a medical face mask the wearer must reach behind his head to tie the straps together. This can be quite awkward, particularly for persons of limited dexterity, and typically assistance is sought both tying and releasing a conventional medical face mask about a wearer's head. When such assistance is not available the wearer must self-fasten the medical face mask. If the wearer is a medical professional who has already scrubbed, as is typically the case, an increased risk of introducing iatrogenic and nosocomial infection to a patient is presented because the wearer invariably contacts his exposed hair and neck which may contain harmful viruses or bacteria commutable to a patient. In addition, in emergency situations the time consumed by the medical professional tying the mask or seeking assistance to tie the mask may make a life or death difference to a patient. Moreover, once a face mask is tied about the wearer's head it may require tightening or readjustment. Such adjustment is difficult for the wearer to perform and will often require the assistance of another in retying the face mask.

Attempts in the art to address these problems have been largely unsuccessful. For example, Haber et al. U.S. Pat. No. 4,790,307 teaches an improved fastening means comprising a pair of generally circular earholes formed at opposite ends of the face mask for receiving the ears of the wearer therethrough. While permitting quick and easy mounting of the mask, the structure is unsatisfactory because it is not adjustable to fit wearers of different size. In addition, the structure is suitable only for short term use because wearers find it uncomfortable to have the mask fastened to their ears for extended periods. Furthermore, such a mask may not be tightened if it becomes loose during the course of an operation or examination. Lastly, mounting such a face mask still requires the wearer to place his hands in the ear and hair area, increasing the risk of introducing harmful bacteria or viruses to a patient.

Hubbard et al. U.S. Pat. No. 4,802,473, teaches a fastening means comprising ear loops formed of lycra spandex attached to the corners of the face mask panel. Although solving some of the problems presented by Haber et al., wearers find these ear loops uncomfortable after extended periods of time. In addition, mounting such a face mask requires a wearer to contact the ear and hair area where harmful bacteria or viruses may contaminate the wearer's hands.

The present invention is directed toward overcoming one or more of the problems discussed above.

SUMMARY OF THE INVENTION

The present invention provides a fastener for a medical face mask that allows quick and easy attachment to the head of a wearer. Use of the fastener decreases the risk of communicating harmful bacteria or viruses to a patient. In addition, a medical face mask using this fastener may be easily manipulated once attached to an individual without requiring the face mask straps to be untied and retied. Moreover, the fastener allows a medical face mask to be secured about a wearer's head by a person of limited dexterity and to be readily adjusted to fit a wearer of any size. Lastly, the fastener may be easily and inexpensively manufactured using presently available medical face masks.

One aspect of the invention is, in a medical face mask of the type having a panel for covering the nose and mouth of the wearer and at least one pair o f spaced apart complementary straps attached to the panel and extending therefrom, the straps being joinable to mount the panel over the wearer's nose and mouth, the improvement comprising a slidable fastener joining the pair of complementary straps and the panel in a loop of adjustable length, the slidable fastener holding the straps in a loop of desired length until the slidable fastener is forcibly, slidably adjusted to increase or decrease the size of the loop.

Another aspect of the present invention is, in a process of manufacturing a medical face mask of the type having a panel for covering the nose and mouth of a wearer and at least one pair of complementary straps attached to the panel and extending therefrom for fastening the panel to the wearer's head, the step of providing a slidable fastener joining the pair of complementary straps in the panel in a loop of adjustable length, the slidable fastener holding the straps in a loop of desired length until the slidable fastener is forcibly, slidably adjusted to increase or decrease the size of the loop.

Either of the above aspects are equally well suited to medical face masks generally of the configuration discussed above and further including an eye shield. An example of such a structure is the FluidShield ® Surgical Mask with Wraparound SplashGuard TM Visor marketed by Tecnol, Inc.

Still other aspects and advantages of the present invention can be obtained from a study of the specification, the drawings, and the appended claims.

DETAILED DESCRIPTION OF THE PREFERRED EMBODIMENT

Figure 1:
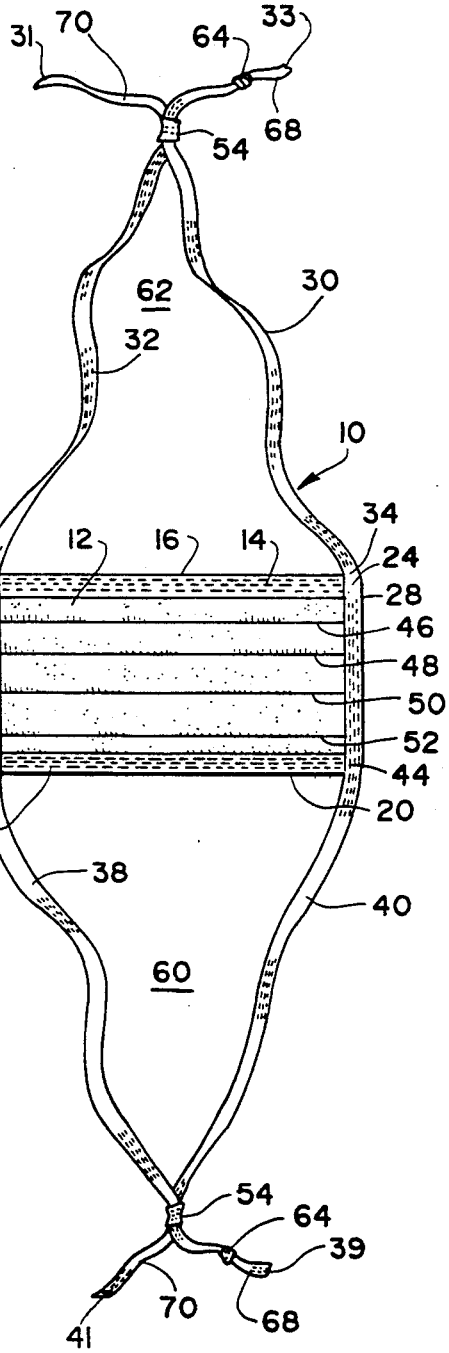
FIG. 1 is a front view of a medical face mask provided with the slidable fasteners according to the present invention.

A typical medical face mask 10 is illustrated in FIG. 1. The medical face mask 10 comprises a rectangular panel 12 with a first binding strip 14 attached to the top 16 of the panel 12, a binding strip 18 attached to the bottom 20 of panel 12, and third and fourth binding strips 22 and 24 attached to sides 26 and 28 of the panel 12. A first pair of complementary tie strings or straps, 30 and 32, extend from the corners 34 and 36 of the top 16 of the panel 12. A second pair of complementary straps 38 and 40 extend from the corners 42 and 44 of the bottom 20 of the panel 12.

The panel 12 of the medical face mask 10 typically contains a plurality of pleats 46, 48, 50 and 52 which allow the panel 12 to expand over the face and mouth of a wearer when mounted. The medical face mask 10 is customarily fastened about the head of the wearer by tying the first pair of straps 30 and 32 into a knot behind the wearer's head. The second pair of straps 38 and 40 are similarly tied behind the wearer's neck. Thus, a typical medical face mask 10 is secured in a manner similar to that illustrated in FIG. 3. Using this conventional technique, the binding strips 14, 18, 22 and 24 forcibly abut the face of the wearer to form a bacteria and virus excluding and confining seal therebetween.

The straps 30, 32, 38, and 40 may either be separately fastened to the corners 34, 36, 42 and 44 of the panel 12 or may be an integral extension of the binding strips 22 and 24 as illustrated in FIG. 1.

Figure 4:
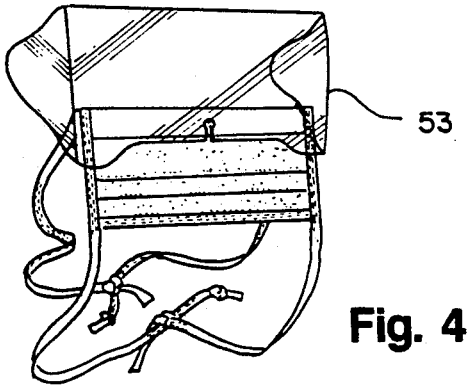
FIG. 4 is a front view of a medical face mask including an eye shield provided with the slidable fastener according to the present invention.

Examples of medical face masks employing a structure similar to that discussed above are Peterson U.S. Pat. No. 4,419,993; Lauer U.S. Pat. No. 3,888,246; V. M. Hubbard et al. U.S. Pat. No. 4,606,341 and V. M. Hubbard et al. U.S. Pat. No. 4,635,628. Tecnol, Inc. markets a mask of a similar structure further including an eyeshield sold under the trademark FluidShield® Surgical Mask with Wraparound SplashGuard™ Visor. Such a configuration is illustrated in FIG. 4 with the eye shield 53 indicated therein. As is clearly evident, the present invention is equally well suited to such medical face masks. This list is not intended to be exhaustive, but merely to demonstrate the breadth of medical face masks upon which the present invention may be disposed.

Figure 2:
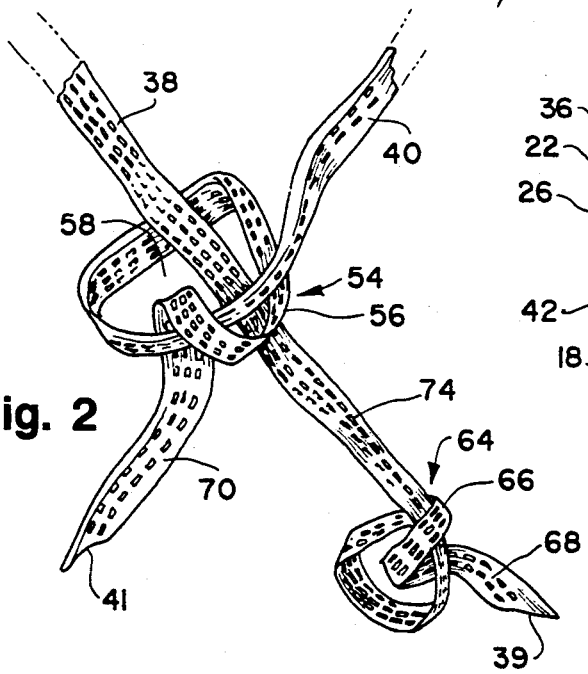
FIG. 2 is an enlarged view of the straps of a medical face mask shown in FIG. 1 illustrating in detail the construction of a slidable fastener according to the present invention.

The present invention is directed towards an improved fastening means for the complementary pairs of straps 30 and 32 and 38 and 40. With reference to FIG. 1, slidable fasteners 54 are formed in one of the straps comprising the complementary pairs of straps 30 and 32 and 38 and 40. As best illustrated in FIG. 2, the slidable fastener 54 comprises an overhand knot 56 defining an aperture 58 formed in strap 40. The other strap 38 passes through the aperture 58. When the overhand knot 56 is tightened about the strap 38 the slidable fastener 54 is formed. Returning to FIG. 1, a loop 60 comprises the strap 40, the other strap 38 and the bottom 20 of the panel 12. Similarly, a loop 62 comprises the strap 30, the other strap 32 and the top 16 of the panel 12.

As seen in FIG. 1 and FIG. 2, stops 64 are formed in the other straps 32 and 38 by an overhand knot 66 formed proximate to the free ends 33 and 39 of the other straps 32 and 38. Tabs 68 are formed beyond the knot 66 by the free ends 33 and 39 of the other straps 32 and 38. In addition, the free ends 31 and 41 of the straps 30 and 40 beyond the overhand knots 56 forms tabs 70.

Figure 3:
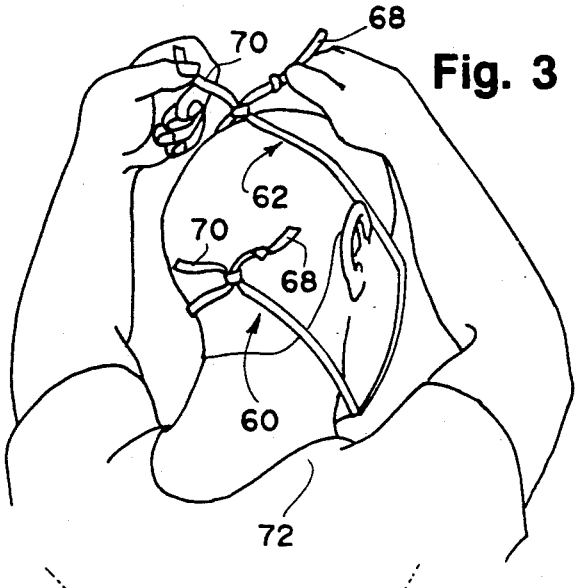
FIG. 3 is a perspective view of a wearer mounting a medical face mask provided with the slidable fasteners according to the present invention.

FIG. 3 illustrates the use of the slidable fastener disclosed herein. As can be appreciated from FIG. 3, a wearer 72 may conveniently secure a medical face mask 10 including the present invention about his head without the aid of others. The wearer must simply place the loops 60 and 62 over his head and position the panel 12 over his nose and mouth. The loop 60 is then secured about the wearer's neck by grasping the tabs 68 and 70 and then pulling them to slide the slidable fastener 54 along the other strap 38. In the same manner, the loop 62 may be secured about the wearer's head.

As is readily apparent from the above description of the physical structure of the preferred embodiment, and as best illustrated with reference to FIG. 2, the present invention is constructed in a medical face mask 10 by tying the strap 40 into an overhand knot 56, thereby defining an aperture 58. The other strap 38 is then inserted through the aperture 58. The overhand knot 56 is tightened about the other strap 38 sufficiently to form the slidable fastener 54 that may be slid along the other strap 38 only by forcible manipulation. A slidable fastener 54 is similarly formed in the strap 30 and the other strap 32 passes therethrough. The stops 64 are formed by tying overhand knots 66 proximate to the free ends 39 and 33 of the other straps 38 and 32. Preferably the overhand knots 56 and 66 are formed away from the free ends 31, 33, 39 and 41 of the straps 30, 32, 38 and 40 to form the tabs 68 and 70.

To practice this invention, the straps must be comprised of a supple material with a coefficient of friction great enough that the loops 60 and 62 will hold in an adjusted position and the knots 56 and 66 will not loosen without forcible manipulation. Use of a flat strap material enhances the desired characteristics because of the deformation of the flat straps when knotted. Moreover, dimpled or perforated straps further enhance the desirable knotting characteristics of the straps.

Hubbard et al. U.S. Pat. No. 4,635,628 discloses a strap material found to yield excellent results. Hubbard et al. discloses a flat strap comprising a single strip of polyester material folded upon itself and heat sealed along the entire length thereof. The heat sealed bonding along the length of the straps creates a plurality of dimples 74 illustrated in FIG. 2. The polyester material, in combination with these dimples and the flat structure provides a material with excellent knotting characteristics.

Peterson U.S. Pat. No. 4,419,993 discloses other strap materials well known in the art that are supple, have relatively high coefficients of friction and may be formed into dimpled flat straps by heat-sealed binding or other binding techniques. These materials include non-woven materials formed by wet-laid or dry-laid processes consisting of rayon, polyester or like fibers; calendared spun-bonded webs of polypropylene, polyethylene or polyester, and reinforced paper. Tyvek®, a polyethylene material manufactured by E.I. DuPont de Nemours & Co. and Teclin®, a polyester material manufactured by Tecnol, Inc. are specific examples of preferred materials.

Nonpreferred but acceptable materials include nylon, cotton, plastic, rubber and poly/cotton blends.

In addition to strap materials bonded by the heat sealing process discussed in Hubbard et al., ultrasonically bonded materials have been found to yield acceptable results. Although not preferred, those skilled in the art will appreciate that certain bonding processes using glue may be acceptable.

The above-described strap materials and bonding processes are not intended as a limitation on the scope of this invention but rather to illustrate strap materials and bonding processes with which the invention may be practiced.

It will be understood by those skilled in the art that the principles of the present invention may be applied not only to medical face masks of the type having two pairs of complementary straps, but also to other structures such as the structure disclosed in Grieer-Idris U.S. Pat. No. 4,662,005 having a single pair of complementary straps.

The above disclosed slidable fastener for a medical face mask is easy to use and inexpensively and easily integrally formed in many conventional medical face masks. The slidable fastener according to this invention may be quickly mounted by a wearer, saving valuable time in critical situations. In addition, a wearer may mount a medical face mask including the slidable fastener according to this invention with a decreased risk of spreading communicable diseases. Finally, medical face masks including the slidable fastener according to this invention may be mounted by a wearer of limited dexterity and easily adjusted to fit any size wearer.

I claim:

1. In a medical face mask of the type having a general for covering the nose and mouth of a wearer and at least one complementary pair of spaced apart, elongate, flexible straps each having one end attached to the panel, the straps extending from the panel and each having a free end spaced from the panel, the complementary pair of straps being joinable to mount the panel on the wearer's head, the improvement comprising:

an overhand knot in only one of the straps of the complementary pair defining a constrictable aperture for reception of the other strap, the other strap of the complementary pair being slidable substantially straight through the aperture so that there is a closed loop defined cooperatively by the pair of complementary straps and the panel to receive the head of a user, the loop being of a diameter that is variable by moving the other strap through the aperture defined by the one strap, the knot in the one strap being tightenable to restrict the aperture size so that the other strap can be closely frictionally embraced by the one strap at the knot to allow a predetermined diameter to be frictionally maintained for said loop whereby the other strap can be forcibly slid through the aperture to reduce the effective loop diameter and thereby tighten the loop about the head of a wearer.

2. The medical face mask of claim 1 wherein the other strap has a stop to prevent its free end from being drawn fully through the aperture.

3. The medical face mask of claim 2 wherein the stop comprises a knot in the other strap.

4. The medical face mask of claim 1 wherein the free ends of the straps form tabs beyond the slidable fastening means.

5. The medical face mask of claim 1 wherein the straps are made of a supple material having a coefficient of friction great enough that the loop will not increase or decrease in size without forcible manipulation.

6. The medical face mask of claim 1 wherein the straps are comprised of heat seal bonded polyester having a plurality of dimples formed therein.

7. The medical face mask of claim 1 wherein the straps are comprised of ultrasonically bonded polyester having a plurality of dimples formed therein.

8. The medical face mask of claim 1 wherein the straps are comprised of glued polyester having a plurality of dimples formed therein.

9. The medical face mask of claim 1 wherein the straps are flat.

10. The medical face mask of claim 1 wherein the panel is generally rectangular having four corners, a top and a bottom edge and a strap extending from each corner, the straps extending from the top edge comprising a first complementary pair of straps, the first complementary pair of straps and the panel being joined by a first slidable fastening means in a first loop of adjustable length, and the straps extending from the bottom edge comprising a second complementary pair of straps, the second complementary pair of straps and the panel being joined by a second slidable fastening means in a second loop of adjustable length.

11. The medical face mask of claim 1 wherein the panel has a top and a bottom edge and further including an optical shield having an upper and a lower edge, the lower edge of the optical shield being attached to the top edge of the panel.

12. The medical face mask of claim 10 further including an optical shield having an upper and a lower edge, the lower edge of the optical shield being attached to the top edge of the panel.

* * * * *

UNITED STATES PATENT AND TRADEMARK OFFICE

CERTIFICATE OF CORRECTION

PATENT NO. : 5,107,547

DATED : 28 April 1992

INVENTOR(S) : Peter W. Scheu

It is certified that error appears in the above-identified patent and that said Letters Patent is hereby corrected as shown below:

In column 5, line 36, delete "general" and insert --panel-- therefor.

Signed and Sealed this

Twenty-second Day of June, 1993

*Attest:*

Michael K. Kirk

MICHAEL K. KIRK

*Attesting Officer*

*Acting Commissioner of Patents and Trademarks*